US012066271B2

(12) United States Patent
Porat

(10) Patent No.: US 12,066,271 B2
(45) **Date of Patent: *Aug. 20, 2024**

(54) HOLSTER ASSEMBLY

(71) Applicant: RT Recover Innovations Ltd., Tel Aviv (IL)

(72) Inventor: Tamir Porat, Tel Aviv (IL)

(73) Assignee: RT Recover Innovations Ltd., Tel Aviv (IL)

( * ) Notice: Subject to any disclaimer, the term of this patent is extended or adjusted under 35 U.S.C. 154(b) by 256 days.

This patent is subject to a terminal disclaimer.

(21) Appl. No.: 17/746,001

(22) Filed: May 17, 2022

(65) Prior Publication Data

US 2022/0276021 A1 Sep. 1, 2022

Related U.S. Application Data

(63) Continuation of application No. 17/122,033, filed on Dec. 15, 2020, now Pat. No. 11,592,262.

(30) Foreign Application Priority Data

Dec. 17, 2019 (IL) ..... 271517

(51) Int. Cl.
*F41C 23/12* (2006.01)
*F41C 23/04* (2006.01)
*F41G 1/06* (2006.01)

(52) U.S. Cl.
CPC ..... *F41C 23/12* (2013.01); *F41C 23/04* (2013.01); *F41G 1/06* (2013.01)

(58) Field of Classification Search
CPC ..... F41C 23/12; F41C 23/04
See application file for complete search history.

(56) References Cited

U.S. PATENT DOCUMENTS

| | | | | |
|---|---|---|---|---|
| 5,479,736 | A * | 1/1996 | Forrester | F41A 11/02 89/14.05 |
| 5,810,221 | A | 9/1998 | Beletsky et al. | |
| 7,134,234 | B1 * | 11/2006 | Makarounis | F41G 11/004 42/114 |
| 7,421,817 | B2 * | 9/2008 | Larsson | F41G 1/35 42/146 |
| 8,256,154 | B2 * | 9/2012 | Danielson | F41A 19/11 42/117 |
| 8,448,366 | B2 * | 5/2013 | Faifer | F41G 11/003 42/72 |
| 8,887,432 | B2 * | 11/2014 | Oz | F41A 35/06 42/71.01 |
| 10,436,553 | B2 * | 10/2019 | Moore | F41G 3/2655 |
| 10,627,189 | B2 * | 4/2020 | Faifer | F41C 33/001 |
| 2012/0131829 | A1 * | 5/2012 | Fistikchi | F41C 23/22 42/1.06 |

(Continued)

*Primary Examiner* — Michael D David

(74) *Attorney, Agent, or Firm* — Dekel Patent Ltd.; David Klein

(57) ABSTRACT

A holster assembly includes an adaptor flange securable to a firearm and formed with an opening, a garment mounting provision, and a holster clip including resilient arms that include inner faces. One of the resilient arms includes a mounting feature that couples to the garment mounting provision. When the firearm is slid and fully holstered into the holster clip, the inner faces of the resilient arms click over a border of the opening and the firearm is securely held in the holster assembly.

4 Claims, 5 Drawing Sheets

(56) References Cited

U.S. PATENT DOCUMENTS

| | | | | |
|---|---|---|---|---|
| 2015/0316346 | A1* | 11/2015 | Brandt | F41C 23/12<br>42/71.02 |
| 2019/0093983 | A1* | 3/2019 | Bruegger | F41C 23/12 |
| 2019/0323795 | A1* | 10/2019 | Zimmer | F41G 11/001 |

* cited by examiner

HOLSTER ASSEMBLY

CROSS-REFERENCE TO OTHER APPLICATIONS

This application claims priority from, and is a continuation of, U.S. patent application Ser. No. 17/122,033, filed 15 Dec. 2020, which is incorporated herein by reference.

FIELD OF THE INVENTION

The present invention relates to firearms in general and, in particular, to a holster assembly for a handgun and the like.

BACKGROUND OF THE INVENTION

Handguns normally are held in one hand while they are being aimed and fired, and that hand may be steadied by the other hand of the shooter or a two-handed grip.

A number of devices designed to attach to a handgun to aid a user in holding or stabilizing the handgun are well known, such as pistol braces. One example of such a brace uses wraps or bands that wrap around the shooter's forearm. Another example uses a vertical stabilizing fin that rests against the inside of the forearm to stabilize an attached handgun during firing.

SUMMARY OF THE INVENTION

The present invention seeks to provide a brace for a pistol with a pivoting brace arm, as is described hereinbelow.

There is thus provided in accordance with a non-limiting embodiment of the present invention a brace assembly including a firearm attachment member to which a pivot arm is pivotally attached at a pivot, the pivot arm including a brace member at an end opposite to the pivot and a manipulation member that extends from a main body of the pivot arm in a direction opposite to the brace member.

In accordance with a non-limiting embodiment of the present invention the manipulation member is located at the end of the pivot arm opposite to the pivot.

In accordance with a non-limiting embodiment of the present invention the manipulation member extends generally perpendicular from the main body of the pivot arm.

In accordance with a non-limiting embodiment of the present invention the pivot arm includes a gun sight that extends generally perpendicular from the main body of the pivot arm near the pivot.

In accordance with a non-limiting embodiment of the present invention the firearm attachment member includes left and right halves fastened to each other with fasteners.

In accordance with a non-limiting embodiment of the present invention the brace member includes a stabilizer that extends generally perpendicular from the main body of the pivot arm and an extension that extends generally perpendicular from the stabilizer.

In accordance with a non-limiting embodiment of the present invention the pivot arm includes a catch biased by a biasing member, the catch being engageable with a portion of the firearm attachment member.

In accordance with a non-limiting embodiment of the present invention a holster assembly is provided that includes a garment mounting provision to which is coupled a holster clip, and a portion of the firearm attachment member is configured to be held in the holster clip.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Reference is now made to FIGS. 1A-3, which illustrate a brace assembly 10 for a firearm 5, in accordance with a non-limiting embodiment of the present invention.

The brace assembly 10 may include a firearm attachment member 12 to which a pivot arm 14 is pivotally attached.

Figure 1A:
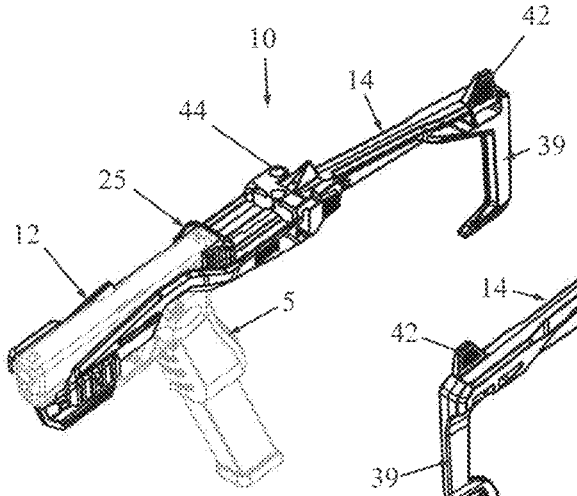
FIGS. 1A and 1B are simplified perspective illustrations, from two opposite sides, of a brace assembly mounted on a firearm, in accordance with a non-limiting embodiment of the present invention, in which a brace arm is in a folded-out position.
Figure 1B:
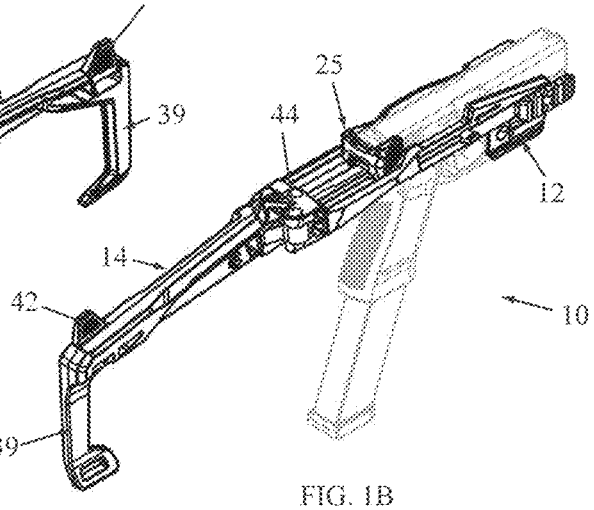
Figure 2A:
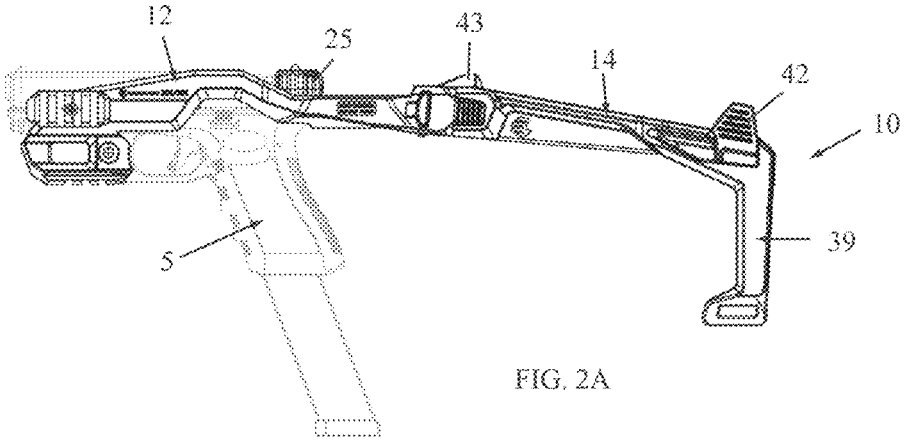
FIGS. 2A and 2B are simplified side-view illustrations of the firearm with the brace assembly in respective folded-out and folded-in positions.
Figure 2B:
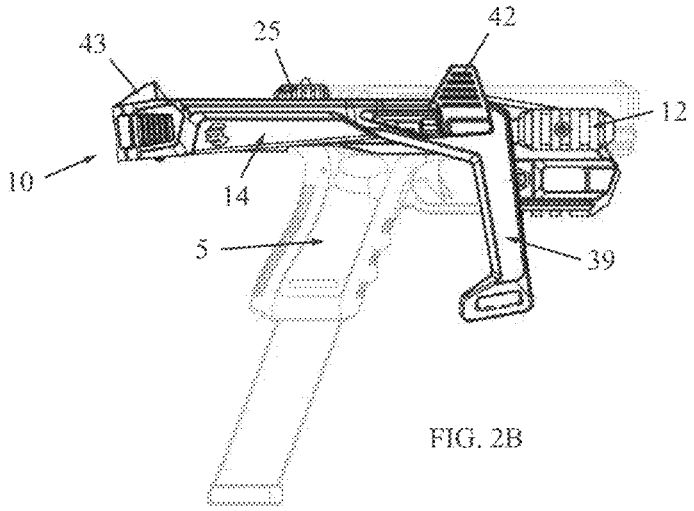
Figure 3:
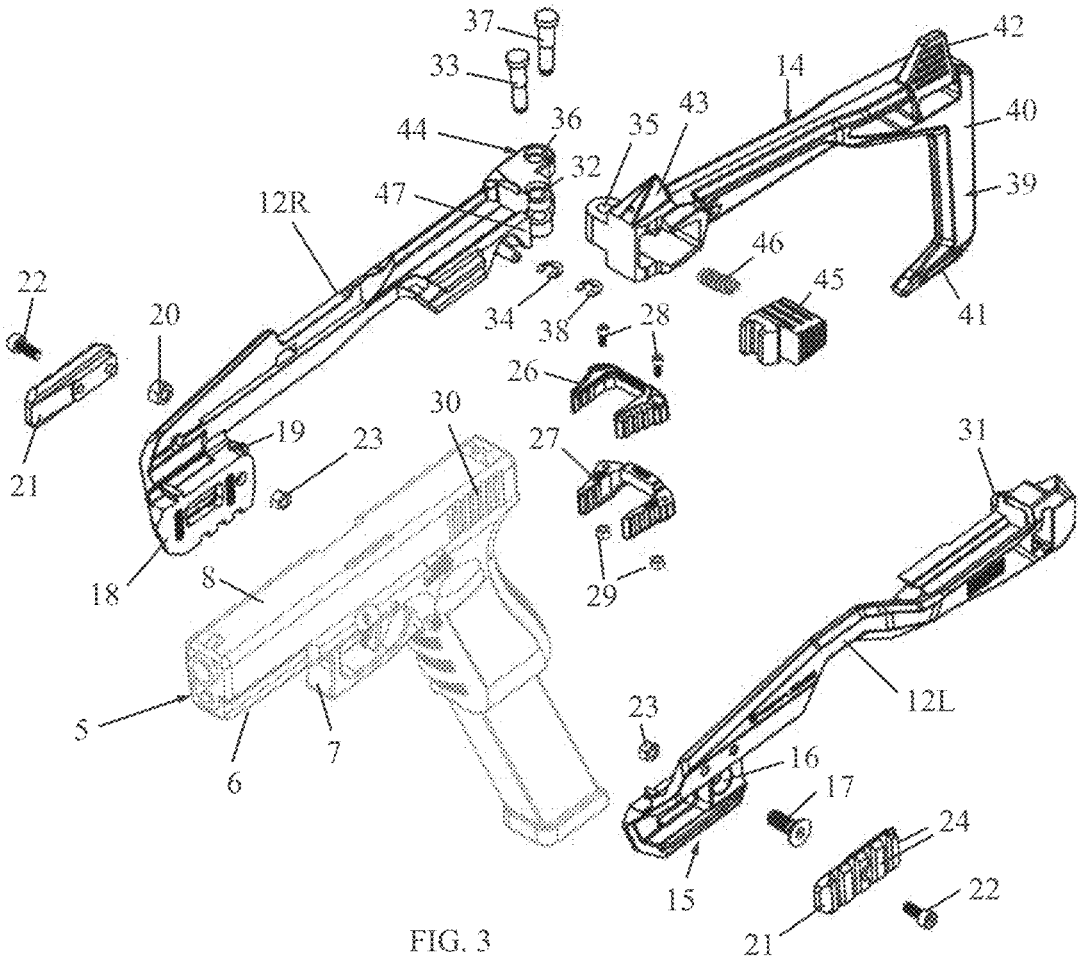
FIG. 3 is a simplified exploded illustration of the brace assembly.

As seen more in detail in FIG. 3, the firearm attachment member may be constructed of left and right halves 12L and 12R. In the illustrated embodiment, attachment member left half 12L includes a distal (i.e., forward) fastening flange 15 configured to be mounted below the receiver 6 and in front of the trigger guard 7 of firearm 5. The distal fastening flange 15 may include a mounting hole 16 through which a screw 17 passes. Similarly, attachment member right half 12R includes a distal fastening flange 18 configured to be mounted below the receiver 6 and in front of the trigger guard 7, and may include a mounting hole 19 for accepting the screw 17 which is tightened on the outer side of flange 18 with a nut 20. A cover plate 21 may be provided for each flange 15 and 18, secured thereto with a screw 22 and nut 23. The cover plate 21 may be formed with rail ridges 24.

The attachment member left half 12L and the attachment member right half 12R are mounted below the slide 8 of firearm 5 and extend rearwards (i.e., proximally) beyond the rear of slide 8. In this manner, the firearm attachment member 12 does not interfere in any way with the operation of the firearm 5.

As an option, a charging handle accessory 25 (FIGS. 1A, 1B, 2A and 2B) may be provided for attachment to the slide 8, In the illustrated embodiment, the charging handle accessory 25 is that of US Patent Application 20180195819, the disclosure of which is incorporated herein by reference. As seen in FIG. 3, charging handle accessory 25 includes an upper member 26 and a lower member 27, both of which may be formed with serrations that mate with external serrations 30 of slide 8. One or more fasteners (e.g., screws 28 and nuts 29) secure the upper and lower members 26 and 27 together.

The proximal end of attachment member left half 12L may include a first hinge member 31, such as a short cylinder with a hole, and attachment member right half 12R may include a second hinge member 32, such as a pair of spaced-apart short cylinders with holes. The first hinge member 31 fits into the gap between the spaced-apart short cylinders of second hinge member 32 and the hinge is completed by a first hinge pin 33 which may be secured by a first circlip 34.

The pivot arm 14 may include a first pivot member 35 which is pivotally connected to a second pivot member 36 on one of the attachment member halves, such as attachment member right half 12R. The pivoted connection is completed by a second hinge pin 37 which may be secured by a second circlip 38. The completed pivot is referred to as pivot 44.

Referring again to FIG. 3, it is seen that pivot arm 14 includes a brace member 39 at an end opposite to first pivot member 35. Brace member 39 may include a stabilizer 40 that extends generally perpendicular from the main body of arm 14 and an extension 41 that extends generally perpendicular from stabilizer 40. A strap (not shown) may be attached to any suitable portion of arm 14, stabilizer 40 or extension 41.

Pivot arm 14 also includes a manipulation member 42 that extends generally perpendicular from the main body of arm 14 in a direction opposite to stabilizer 40 (upwards when the firearm is held normally for shooting). The manipulation member 42 may be pushed or pulled by the shooter to swing pivot arm 14 about pivot 44. This is important because without manipulation member 42, the shooter must move the brace away from the shooter's body in order to swing the brace to an extended or contracted position; with manipulation member 42 the pivot arm 14 is easily and quickly moved to an extended or contracted position without moving the firearm away from the shooter's body.

Pivot arm 14 also includes a gun sight 43 that extends generally perpendicular from the main body of arm 14 near the pivot 44. Pivot arm may be latched into place in the extended position by means of a catch 45 biased by a biasing member 46 (e.g., a coil spring). Catch 45 clicks onto and engages a portion 47 of attachment member right half 12R when in the extended position. Catch 45 may be disengaged by pushing catch 45 against biasing member 46, so that the pivot arm 14 can be folded against the firearm.

Figure 4A:
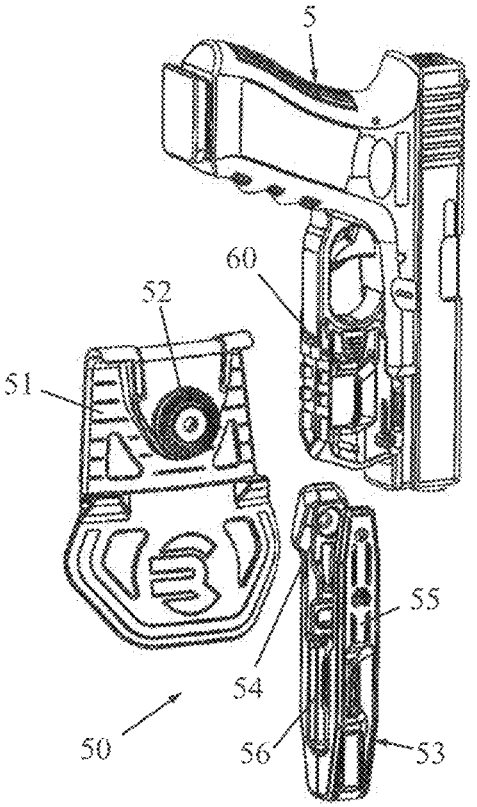
FIGS. 4A and 4B are simplified perspective illustrations of a holster assembly which may be used with the brace assembly, in accordance with a non-limiting embodiment of the present invention.
Figure 4B:
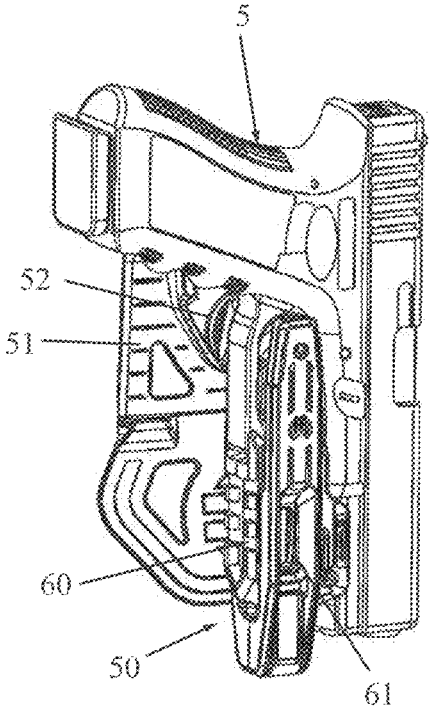

Reference is now made to FIGS. 4A and 4B, which illustrate a holster assembly 50, which may be used with the brace assembly 10, in accordance with a non-limiting embodiment of the present invention.

Holster assembly 50 may include a paddle 51 equipped with a hub 52 (which may be serrated, as is known in the art) for attaching thereto a holster clip 53. For example holster clip 53 may have a U-shaped body with a mounting hole 54 for attaching to hub 52 with a fastener. The serrated hub 52 allows attaching holster clip 53 at any desired angle with respect to the vertical. Thus, in the illustrated embodiment, holster assembly 50 is a paddle holster. Alternatively, holster 50 may be a belt-loop holster, in which case instead of a paddle, the holster assembly 50 is provided with appropriate loops for inserting a belt therein (not shown). Holster 50 may in general have any type of garment mounting provision, and paddle 51 is just one type of garment mounting provision.

Figure 4C:
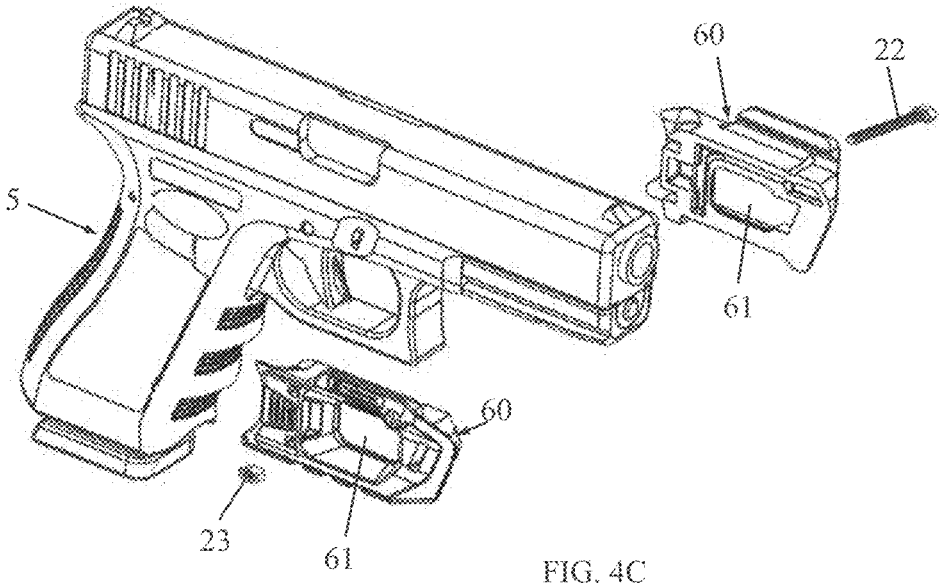
FIG. 4C is a simplified pictorial illustration of attaching a flange to the firearm, the flange serving as an adaptor for using the holster.

FIG. 4C illustrates attaching a flange to the firearm 5. In one embodiment, flange is none other than the combination of flanges 15 and 18 and is part of the brace assembly of FIGS. 1A-3. Alternatively, the flange may be a separate flange 60, used as an adaptor for using the holster 50.

Flange 60 (as well as flanges 15 and 18) includes an inner opening 61. Holster clip 53 has resilient arms 55 that include inner faces 56. When the firearm 5 is slid and fully holstered into holster clip 53, the inner faces 56 of resilient arms 55 click over the border of opening 61 and the firearm 5 is securely held in the holster.

Figure 5A:
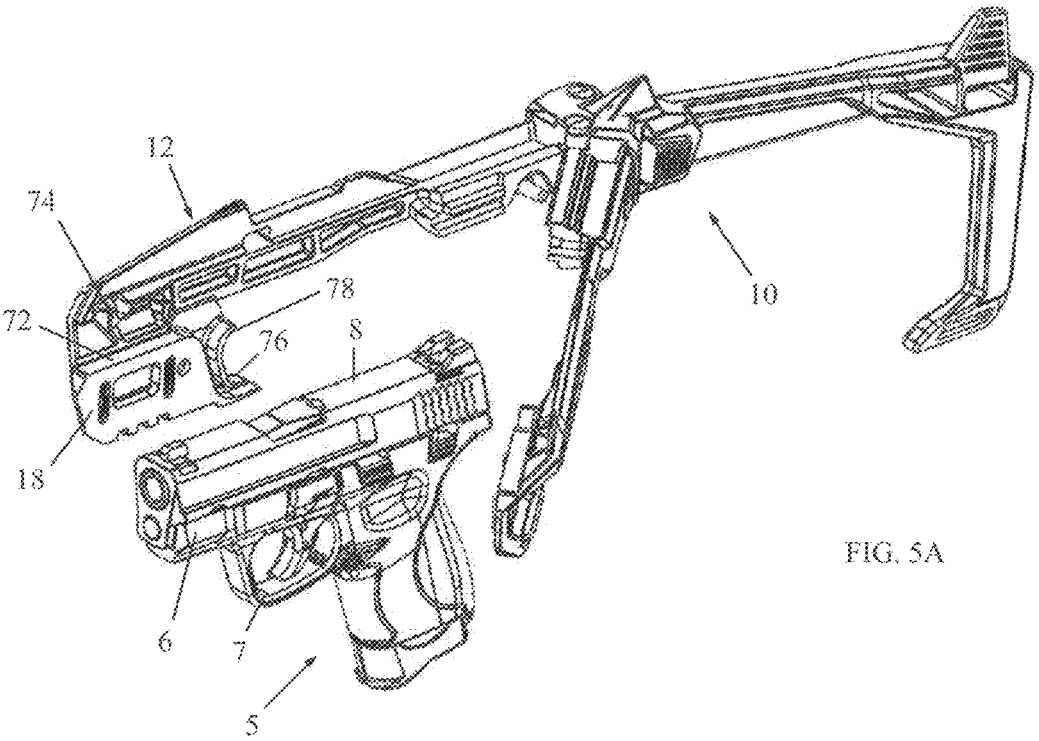
FIGS. 5A and 5B are simplified perspective illustrations of the brace assembly with a firearm mounting structure in the firearm attachment member, in accordance with a non-limiting embodiment of the present invention, respectively before and after placing the firearm in the firearm mounting structure.
Figure 5B:
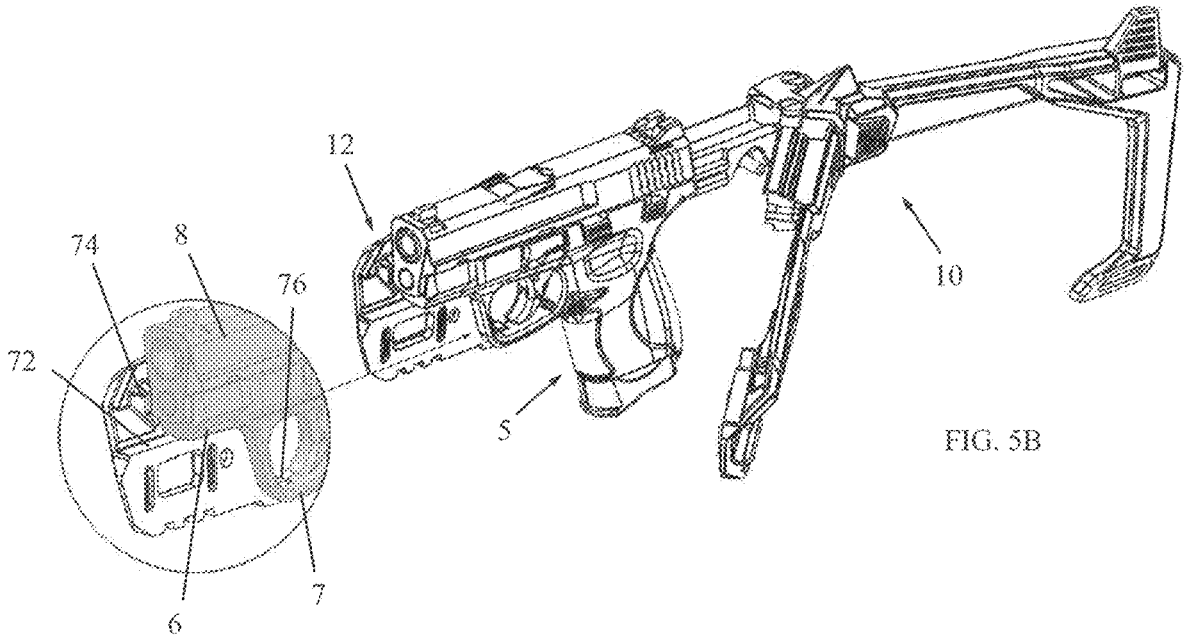

Reference is now made to FIGS. 5A and 5B, which illustrate brace assembly 10 with a firearm mounting structure in the firearm attachment member 12, in accordance with a non-limiting embodiment of the present invention. The firearm mounting structure may be part of the distal fastening flange 18. The firearm mounting structure may include a receiver support shelf 70 upon which the receiver 6 of the firearm 5 rests, and a distal abutment 72 against which the forward end of receiver 6 and/or slide 8 of the firearm 5 can abut. The firearm mounting structure may include a trigger guard abutment member 74 positioned on distal fastening flange 18. The trigger guard abutment member 74 is arranged to fit over a portion of trigger guard 7 of firearm 5. In this manner, firearm 5 is positively held in place and is restrained from moving forward (distally) by distal abutment 72, restrained from moving downwards by receiver support shelf 70 and restrained from moving upwards and rearwards by trigger guard abutment member 74. The firearm mounting structure may also include a stop member 78 (which may be arcuate) against which trigger guard 7 may abut.

Figure 6A:
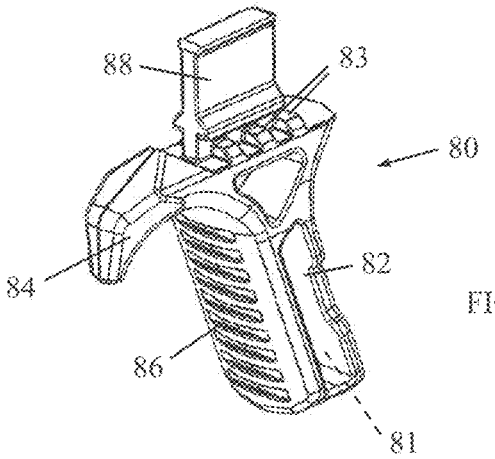
FIG. 6A is a simplified perspective illustration of a foregrip for use with the brace assembly, in accordance with a non-limiting embodiment of the present invention, respectively.
Figure 6B:
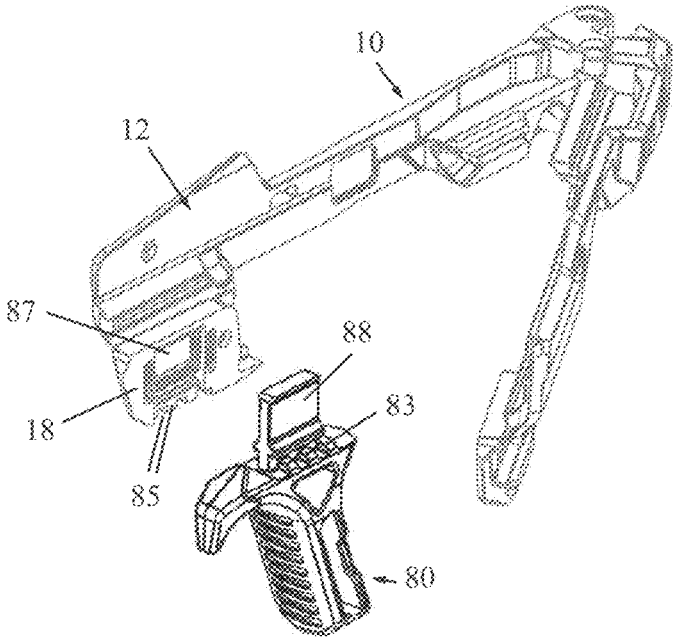
FIGS. 6B and 6C are simplified perspective illustrations of the foregrip, respectively before and after placing the foregrip in the brace assembly.
Figure 6C:
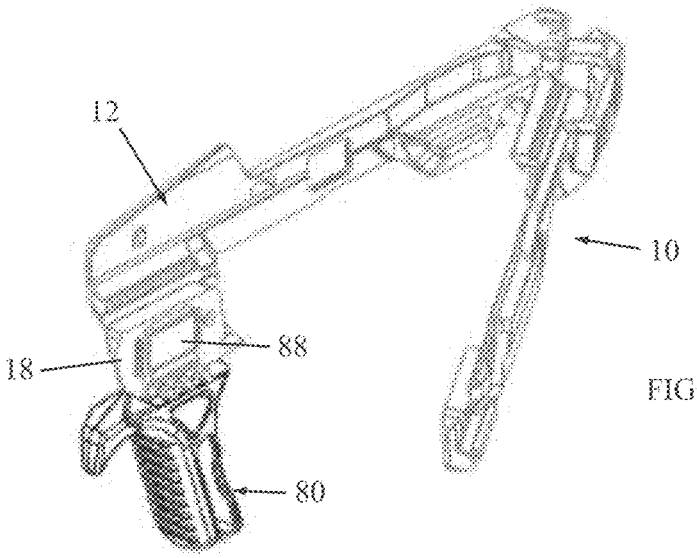

Reference is now made to FIG. 6A, which illustrates a foregrip 80 for use with the brace assembly 10, in accordance with a non-limiting embodiment of the present invention. Foregrip 80 may include a grip member 82, which may have a distal arcuate finger abutment 84 extending from an upper portion of a forward face 86 of the grip member 82. Foregrip 80 may include mounting structure for mounting to the distal fastening flange 18 (flange 18 is seen in FIGS. 6B and 6C). The mounting structure may include male-female rail members 83 on an upper surface of the grip member 82, which mate with corresponding female-male rail members 85 (FIG. 6B) of distal fastening flange 18. Alternatively or additionally, the mounting structure may include an upwardly protruding flange 88 which is received in a socket 87 (FIG. 6B) of flange 18.

FIGS. 6B and 6C illustrate foregrip 80, respectively before and after mounting in the brace assembly 10. Foregrip 80 may have a hollow interior 81 for receiving therein a spare magazine.

What is claimed is:

1. A holster assembly comprising:

an adaptor flange securable to a firearm and formed with an opening;

a garment mounting provision; and a holster clip comprising resilient arms that include inner faces, one of said resilient arms comprising a mounting feature that couples to said garment mounting provision, wherein when the firearm is slid and fully holstered into said holster clip, said inner faces of said resilient arms click over a border of said opening and the firearm is securely held in the holster assembly, wherein said resilient arms extend over a trigger guard of the firearm when the firearm is securely held in the holster assembly, and wherein said adaptor flange comprises two halves, and wherein said holster clip and said resilient arms form a U-shaped body.

2. The holster assembly according to claim 1, wherein said garment mounting provision comprises a paddle equipped with a hub for attaching thereto said holster clip.

3. The holster assembly according to claim 1, further comprising a firearm attachment member to which a pivot arm is pivotally attached at a pivot, said pivot arm comprising a brace member at an end opposite to said pivot, and wherein said firearm attachment member comprises firearm mounting structure which comprises a receiver support shelf for supporting thereon a receiver of the firearm, and wherein said firearm attachment member is constructed of left and right halves each of which comprises a forward fastening flange configured to be mounted below the receiver and in front of a trigger guard of the firearm, and said adaptor flange comprises said forward fastening flanges.

4. A holster assembly comprising:

a firearm comprising a barrel and a trigger guard;

an adaptor flange secured to said firearm, wherein said adaptor flange is forward of said trigger guard underneath said barrel and is formed with an opening;

a garment mounting provision; and a holster clip comprising resilient arms that include inner faces, one of said resilient arms comprising a mounting feature that couples to said garment mounting provision, wherein when the firearm is slid and fully holstered into said holster clip, said inner faces of said resilient arms click over a border of said opening and the firearm is securely held in the holster assembly, wherein said resilient arms extend over a trigger guard of the firearm when the firearm is securely held in the holster assembly, and wherein said adaptor flange comprises two halves, and wherein said holster clip and said resilient arms form a U-shaped body.

* * * * *